US006668998B1

(12) United States Patent
Mosteller et al.

(10) Patent No.: US 6,668,998 B1
(45) Date of Patent: Dec. 30, 2003

(54) HOOK ARRAY FOR A BILL ACCEPTOR

(75) Inventors: Herb Mosteller, Brandamore, PA (US); Robert Daniels, Upper Darby, PA (US)

(73) Assignee: Mars, Incorporated, McLean, VA (US)

( * ) Notice: Subject to any disclaimer, the term of this patent is extended or adjusted under 35 U.S.C. 154(b) by 42 days.

(21) Appl. No.: 09/972,130

(22) Filed: Oct. 5, 2001

Related U.S. Application Data

(60) Provisional application No. 60/239,799, filed on Oct. 12, 2000.

(51) Int. Cl.[7] ..... G07F 7/04
(52) U.S. Cl. ..... 194/203
(58) Field of Search ..... 194/203, 206, 194/207, 347, 349; 379/145

(56) References Cited

U.S. PATENT DOCUMENTS 777,525 A * 12/1904 Long ..... 194/203
5,259,490 A * 11/1993 Gardellini ..... 194/203
5,325,952 A 7/1994 McGinley et al. ..... 194/203
5,887,695 A * 3/1999 Hatamachi et al. ..... 194/207
6,021,881 A * 2/2000 Wild ..... 194/203

FOREIGN PATENT DOCUMENTS

CH 680399 * 8/1992 ..... 194/203

* cited by examiner

*Primary Examiner*—F. J. Bartuska
(74) *Attorney, Agent, or Firm*—Fish & Richardson P.C.

(57) ABSTRACT

A hook array for use with a currency validator is described. The hook array includes a plurality of tree-shaped teeth that form restricted openings between them. In an implementation, the teeth may span a currency passageway of a bill acceptor and be angled such that any string-like member attached to a bill will be trapped within a restricted opening to prevent extraction of the bill.

27 Claims, 4 Drawing Sheets

HOOK ARRAY FOR A BILL ACCEPTOR

This application claims priority from U.S. provisional application no. 60/239,799 filed Oct. 12, 2000.

TECHNICAL FIELD

This invention relates to fraud protection for bill acceptors, and more particularly to an anti-string fraud device and method.

BACKGROUND

Various types of banknote or bill validators for use in automatic transaction machines, such as vending machines, are known. Typically, a consumer inserts coins and bills into such vending machines in order to purchase a product or service. Currency validators receive paper money and perform various authenticity and denomination tests, and then either accept the tendered item as valid or reject the item and return it to the consumer. When accepted as genuine currency, the bill is usually transported to a cash box where it is stored and a selected item is vended along with any change that may be due.

Thieves have been known to attempt to cheat vending machines to receive products or services without actually paying for them. For example, a thief may insert counterfeit money, or may attempt to defraud by other means such as by attaching a string-like member to a bill and then manipulating the string to retrieve the bill after it has been accepted by the bill validator. This type of fraud is commonly known as "string-fraud". Although areas containing automatic transaction machines, such as vending machines and gaming machines, are increasingly monitored by automatic video devices, the string-fraud technique can be difficult to detect during or after an occurrence because during normal operation of the machine genuine bills are returned to consumers if they cannot be validated due to wear or foreign matter. Thus, there is a need for a device to prevent string-fraud that is simple to implement and low cost.

SUMMARY

The present invention concerns a hook array for use with a bill acceptor that includes a plurality of tree-shaped teeth. The teeth form restricted openings therebetween and in use are positioned in a currency passageway of the bill acceptor. The teeth are angled such that any string attached to a bill will be trapped within a restricted opening to prevent extraction of the bill.

The invention may include one or more of the following features. The hook array may include a baseplate connected to the teeth. The baseplate may include at least one connection point, may contain at least one cut-out portion, and may include at least one flange. One or more of the restricted openings may include sharp edges. A top portion of at least one of the teeth may be smooth to promote unimpeded travel of a bill, and an inner surface of at least one of the teeth may be abrasive to promote obstruction of travel of a bill out of a cash box. The baseplate and the teeth may be of a unitary construction.

In another implementation, a bill acceptor includes a bill validator having a bill entryway that leads to a first portion of a currency passageway, wherein the bill validator is operative to authenticate inserted bills. A currency stacker and cash box assembly is connected to the bill validator, and the stacker and cash box assembly form a second portion of a currency passageway therebetween and operate to store accepted bills in the cash box. A hook array is positioned between the cash box and the bill validator, and the hook array includes a plurality of tree-shaped teeth that include restricted openings therebetween for capturing any string attached to a bill that has been accepted and pushed into the cash box, the hook array operative to inhibit retrieval of the bill from the cash box and out of the currency entryway.

The above implementation may include one or more of the following features. The hook array includes a baseplate having at least one connection point. The baseplate may include at least one cut-out portion, and may include at least one flange. At least one of the restricted openings may include sharp edges. A top portion of at least one of the teeth may be smooth to promote unimpeded travel of a bill into the cash box. An inner surface of at least one of the teeth may be abrasive to promote obstruction of travel of a bill out of a cash box. The baseplate and the teeth may be of a unitary construction.

In another implementation, a hook array is connected to a pusher plate of a bill stacker and includes a plurality of tree-shaped teeth that form restricted openings therebetween. The teeth are angled to trap any string-like member attached to a bill within a restricted opening to prevent extraction of a bill.

A further implementation concerns a method for preventing string-fraud. The method includes fabricating a hook array to have a plurality of tree-shaped teeth that form restricted openings therebetween, attaching the hook array within a bill passageway between a bill validator and a cash box, and trapping any string-like member connected to a bill in the restricted openings.

The method may further include one or more of the following features. The hook array may be connected to the cash box. The hook array may be connected to a pusher plate of a bill stacker.

The hook array according to the invention advantageously prevents a thief from extracting an accepted bill from a cash box. Further, when a string-fraud is attempted and the machine jams, service personnel arrive and verify that a fraud has been attempted so that a surveillance tape can be checked to identify the thief for possible arrest or banishment from the establishment. Yet further, after a thief repeatedly fails to succeed in his attempts to defraud the machine, the incidence of string-fraud attempts will drop.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
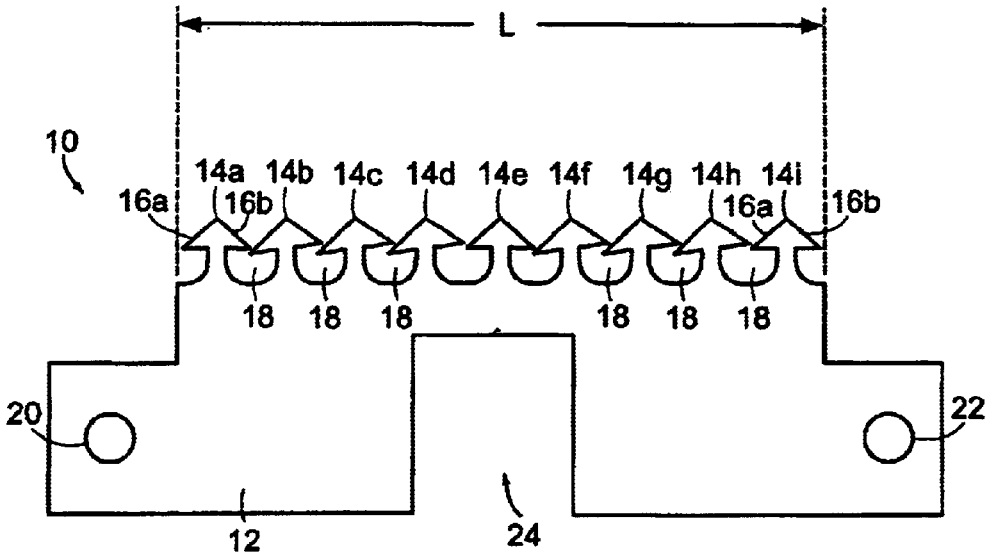
FIG. 1 is a plan view of an implementation of a hook array according to the invention.
Figure 2:
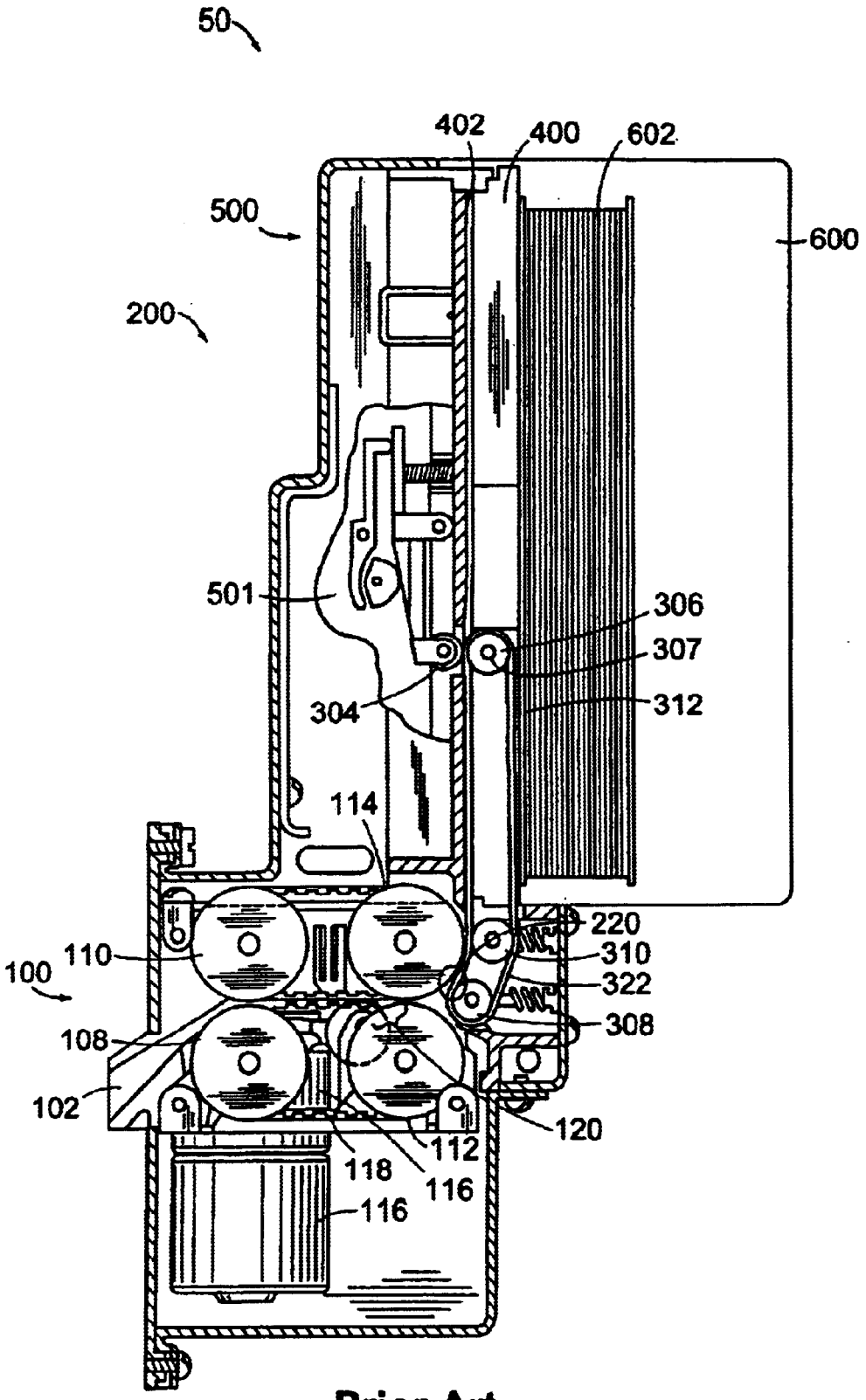
Prior Art FIG. 2
FIG. 2 illustrates an implementation of a currency acceptor assembly which may include a hook array according to the invention.

FIG. 1 is a plan view of an embodiment of a hook array 10 for use with a currency validator (shown in FIG. 2). The hook array includes a baseplate 12 and a plurality of tree-shaped teeth 14*a* to 14*i* connected to the baseplate. Each of the teeth 14 includes branches 16*a* and 16*b* that overlap with, but do not contact, the branches of neighboring teeth to form restricted openings 18 between them. The branches 16*a* and 16*b* of each of the teeth are angled downward to encourage any string-like member or other foreign matter to fall into the restricted openings which will be explained in detail below. The term "string-like member" as used herein denotes any type of string, thin natural fiber or artificial fiber, monofilament line, thin cord, thread, twine, tape, wire or the like that could be attached to a bill.

Referring again to FIG. 1, the teeth 14*b*–14*d* and 14*f*–14*h* have branches that are also offset from a plane that is parallel to the baseplate 12. The geometry of the teeth is optimized in this manner to minimize the amount of travel that a string attached to a bill must move to become caught in one of the restricted openings between adjacent teeth. The number of teeth fabricated along the length "L" is chosen such that they extend for a length approximately equal to the width of a currency passageway, as will be explained in more detail below. In addition, the hook array 10 may be a of a one-piece construction, may include connection points such as the two openings 20 and 22 for attachment to a cash box or other portion of a currency acceptor assembly, and may include one or more cut-out portions 24 in order to permit the easy retrofit of the hook array to a currency acceptor device, as will be explained below.

FIG. 2 illustrates an implementation of a currency acceptor assembly 50 that includes a currency validator 100 connected to a currency stacker 200. The details of the validator 100 pertaining to banknote validation are not part of this invention, and thus those aspects of the validator are not discussed further below. Further, various aspects of the electrical and mechanical connection of the validator 100 and the stacker 200 do not form a part of this invention and they also are not further described below. Yet further, it should be understood that the currency acceptor assembly 50 illustrated in FIG. 2 is just one example of a currency acceptor configuration which may be retrofit with the hook array 10.

Briefly, validator 100 determines whether inserted banknotes are acceptable. As used herein, the terms banknote, bill, security document, paper currency and the like denote items that are legal tender in exchange for goods or service, and that may be inserted into a currency acceptor for validation and storage in return for a good or service. Banknotes are inserted one at a time into validator 100 at a banknote entrance 102. From entrance 102, a banknote is transported through the validator to the validator's banknote output by a series of pairs of pulleys or rollers 108, 110, 112 and 114 and a pair of belts 118 which grip the side edges of the banknote and which are driven by a drive means 116 including a motor and drive train.

While the banknote is transported through the validator 100, it is tested by a group of sensors to ascertain its validity and denomination. Output signals from the sensors are processed by logic circuits in validator 100 to determine whether the banknote is acceptable. A banknote which is unacceptable is ejected back out through entrance 102 by reversing the drive means 116.

An acceptable banknote is driven by the pairs of belts 118 and the pairs of rollers 112 and 114 into an interconnection region 120 in which the validator 100 and the stacker 200 are connected together. In this example, the stacker 200 and cash box 600 are connected to the validator 100 in what is commonly known as an "up-stacker" configuration because accepted bills are transported from a horizontal orientation upwards to a vertical orientation. It should be understood, however, that a hook array according to the invention might be used in currency acceptors configured in other ways, such as in a "down-stacker" configuration. Referring again to FIG. 2, the interconnection means in the interconnection region 120 establishes a smooth uninterrupted path for a banknote to follow in leaving validator 100 and entering stacker 200. The interconnection means establishes the initial portion of the banknote path in the stacker 200 and serves to direct the leading edge of the banknote to the region 220 where the two side edges of the banknote are gripped between rollers 308, belts 312 and stacker drive rollers 114.

The stacker 200 includes transport means having a series of pairs of pulleys 306, 308 and 310, a pair of belts 312, and a pair of retractable pinch rollers 304. It should be recognized that one of each of the above components 306, 308, 310 and 312 is located on each side of the banknote path, and the validator roller 114 drives the transport means.

The accepted banknote is transported from the stacker's entrance into a pre-storage compartment 400. In a fashion somewhat analogous to the way that a picture frame holds a picture, compartment 400 "frames" the banknote and holds it stiff prior to stacking. It should be understood that compartment 400 does not "frame" the leading and trailing edges of a banknote but only its two side edges. A central region is open, and a pusher plate 502 (shown in FIG. 3) which is part of pusher means 500 passes through this opening as it strips a banknote from compartment 400, and pushes it into cash box 600.

After a predetermined distance of travel sufficient to allow the accepted banknote to be fully driven into compartment 400 by the transport means, the retractable pinch rollers 304 are retracted, and the pusher means 500 is operated. (It should be understood that other types of bill acceptors might use alternate methods to transport a bill into a prestorage compartment and to monitor its progress before storing the bill.) A mechanical portion 501 of the pusher means is shown, but the details of its operation are not part of the present invention and thus will not be discussed in detail herein. Pusher means 500 forces the accepted banknote from prestorage compartment 400 into a stack 602 in the cash box 600 where it is stored until removed by service personnel. The cash box is designed to be readily removed, or opened so that stacked banknotes can be removed. Now that the overall operation from banknote insertion to stacking and removal has been briefly discussed, the details of the apparatus according to the present invention will be described in greater depth.

Figure 3:
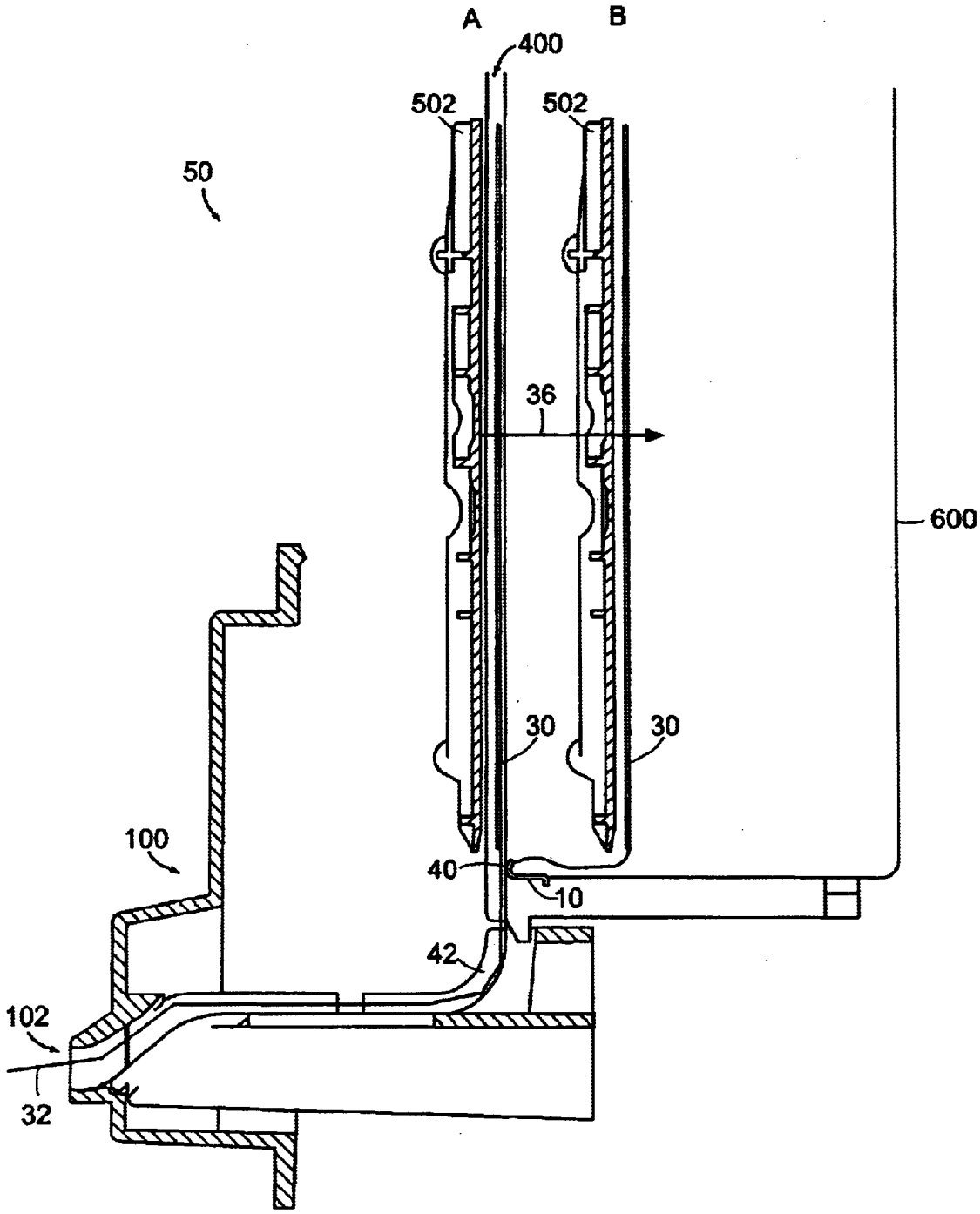
FIG. 3 is a partial schematic diagram of a currency acceptor assembly incorporating a hook array according to the invention.

FIG. 3 is a partial schematic diagram of a currency acceptor assembly 50 incorporating the hook array 10. FIG. 3 illustrates two positions "A" and "B" of the pusher plate 502 for the case wherein a thief has inserted a genuine bill 30 and attached string 32 into the currency validator 50. This is done by a thief to defraud the currency acceptor by first allowing the bill to be authenticated and then stored in the cash box, receiving the product or service, and then pulling on the string to retrieve the bill from the cash box back out of the entryway. The thief inserted the bill connected to the string 32 into entryway 102 wherein it was accepted by bill validator 100, and then transported to the bill stacker for storage in the cash box 600. The bill is first transported to the pre-storage compartment 400 wherein the pusher plate 502 was in position A. The pusher plate 502 then operates to move in the direction of arrow 36 to position B and pushes the bill 30 into cash box 600. As the bill 30 is moved in this manner to position B, the motion of the pusher plate 502 and movement of the bill 30 drags the string 32 against hook array 10 wherein the downwardly angled branches 16*a* and 16*b* of the teeth 14 encourage the string 32 to drop into one of the restricted openings 18 (see FIG. 1) wherein the string is trapped. When the thief then attempts to retrieve the bill 30 by pulling on the string 32, the trailing edge of the bill will be blocked by the teeth in area 40 from moving backwards toward the bill entryway. As shown in FIG. 3, the hook array 10 is interposed between the cash box 600 and a first portion of the currency passageway 42 to inhibit such retrieval of paper currency. If the string 32 is relatively weak, it may snap when the thief pulls. Since the bill has already been safely stored, this is an acceptable result. Alternately, the thief may abandon the string when he realizes that the bill cannot be retrieved which may cause the currency validator to go out of service. Although the next customer who tries to use the automatic transaction machine will be disappointed, such an event is somewhat beneficial because then a service call is required. When service personnel arrive and verify that a fraud has been attempted, a surveillance tape can be checked to identify the thief for possible arrest or banishment from the establishment. Further, after a thief repeatedly fails to succeed in his attempt to defraud the machine, the incidence of string-fraud attempts will drop.

Figure 4:
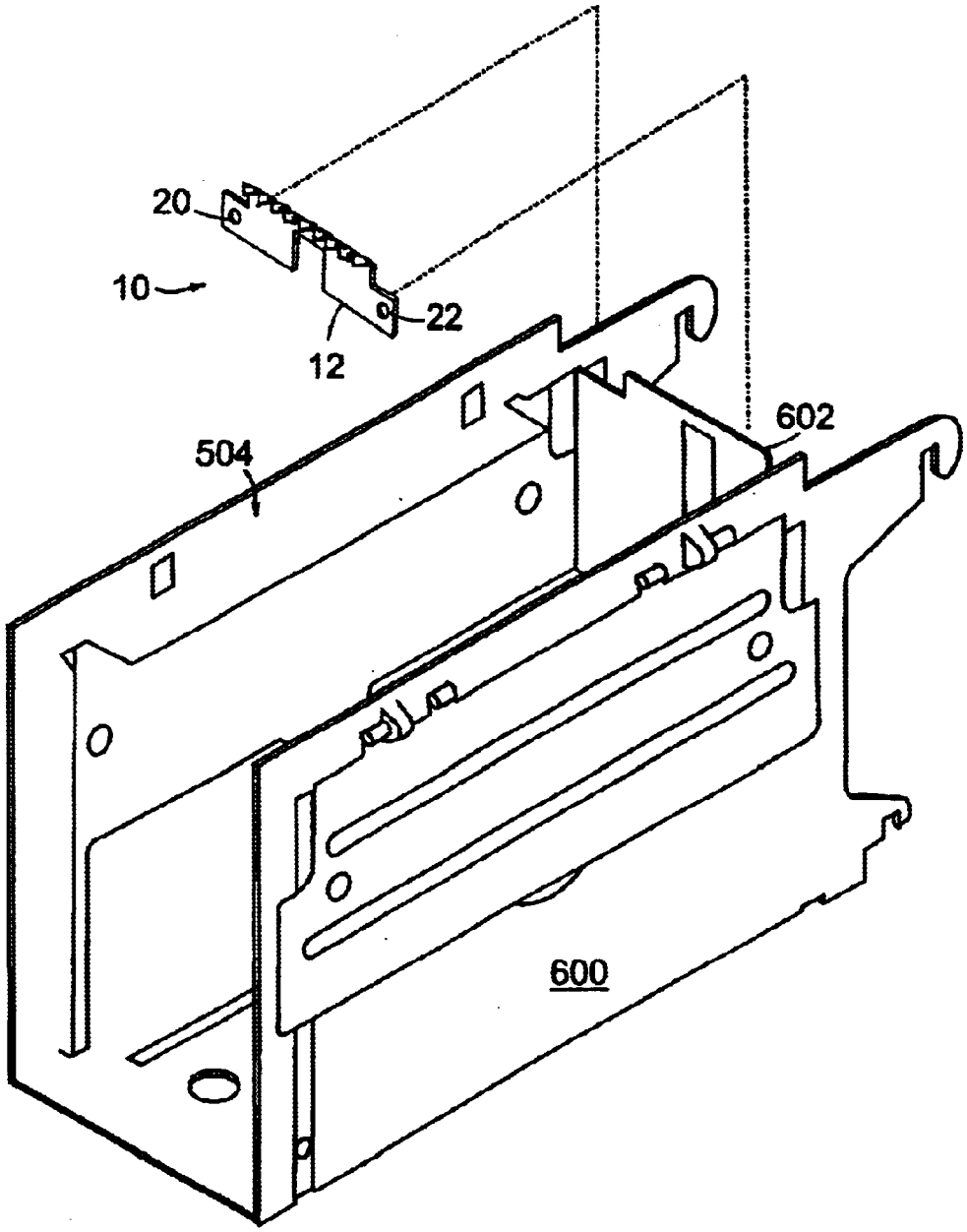
FIG. 4 is a partial cutaway view of an implementation of a cash box illustrating the connection of a hook array according to the invention.

FIG. 4 is a partial cutaway view of an implementation of a cash box 600 to illustrate connection of a hook array 10. As shown, the hook array 10 may be connected to a side wall 602 using connection points 20, 22 (see FIG. 1). The hook array is connected such that the teeth 14 are oriented to be positioned to face in a slightly inward direction with relation to bill opening 504. The teeth are therefore angled towards the stacked notes so that they do not obstruct any part of an accepted bill as it is pushed into the cash box 600. It should be understood that the base 12 of the hook array can be formed to include alternate connection points and cut-out portions to enable the easy retrofit to existing cash boxes for various currency acceptor assemblies, as well as to fit new currency acceptor designs. It should also be understood, however, that a base plate 12 need not be part of the hook array 10 structure.

Figure 5A:
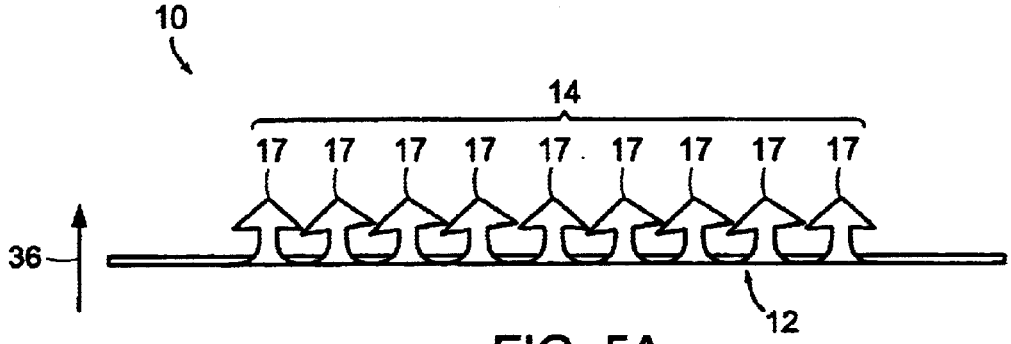
FIGS. 5A and 5B are an end view and a perspective view, respectively, of a hook array of FIG. 1.
Figure 5B:
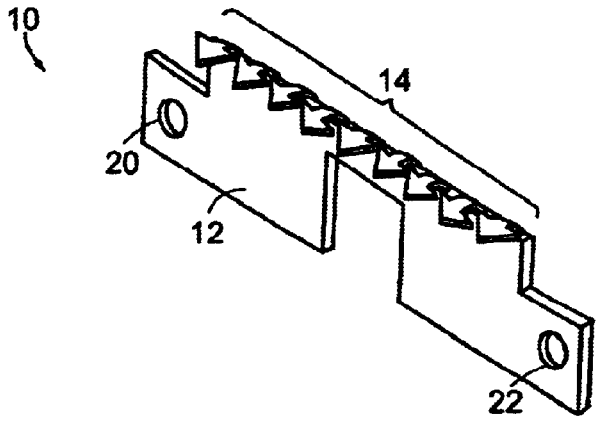

FIG. 5A is an end view of an implementation of the hook array 10 of FIG. 1 taken along a plane parallel to the baseplate 12, and FIG. 5B is a perspective view. FIGS. 5A and 5B illustrate that the tree-shaped teeth 14 are angled, and when connected to a bill acceptor assembly the teeth face towards the cash box 600 in the direction of arrow 36 (as shown in FIG. 3) so as not to impede the progress of an accepted bill. Further, the top portions 17 of the teeth 14 may be made smooth to further allow for unimpeded entry of a bill into the cash box, and to encourage a string to enter and be trapped within a restricted opening 18. In contrast, the lower, inner surface of the teeth 14 that forms the restricted opening may be rough or abrasive to promote obstruction of a bill in the reverse direction.

Alternate implementations of a hook array structure may include a base plate 12, a plurality of tree-shaped teeth 14, a cut-out portion 24 and an aperture or connection point. An alternate hook array may include a base plate 12, teeth 14, central cut-out portion 24 and two Disconnection points located on flanges. Another alternate hook array may include a base plate 12, teeth 14, central cut-out portion 24, flanges and connection points. It should be understood that the connection points could be circular, oval or some other shape. Further, the flanges could be of different dimensions and shape in order to facilitate connection to a currency acceptor, cashbox or other support structure. As described above, when the hook array is connected, the teeth permit a banknote to enter a cashbox and prevent a thief from pulling the banknote back out of the currency acceptor by using a string to retrieve the banknote. In particular, any string attached to the banknote would be captured in a restricted opening.

A number of embodiments of the invention have been described. Nevertheless, it will be understood that various modifications may be made without departing from the spirit and scope of the invention. For example, the hook array 10 may include areas within the restricted openings 18 that have sharp edges or blade structures that may operate to engage, cut, rip or tear the string when a thief attempts to pull a bill out of the cash box. Such sharp edges may be fabricated to only engage and cut objects that move in a direction that is opposite to the direction of an accepted bill that has been stacked in the cash box. If the restricted openings include such sharp edges, then the largest diameter of the restricted openings should be made sufficiently small to prevent insertion of a finger in order to protect personnel entrusted with removing and emptying full cash boxes. Furthermore, the hook array 10 could be configured for attachment to a pusher plate 502 to capture any string attached to a bill and prevent the bill from being extracted from the cash box. Accordingly, other embodiments are within the scope of the following claims.

What is claimed is:

1. A hook array for use with a bill acceptor comprising a plurality of tree-shaped teeth forming restricted openings therebetween and positioned in a currency passageway of the bill acceptor, wherein at least some of the teeth that are adjacent one another in a direction across a width of the passageway partially overlap one another without contacting one another, and wherein the teeth are angled such that my a string-like member attached to a bill will be trapped within a restricted opening to prevent extraction of the bill.

2. The apparatus of claim 1 further comprising a baseplate connected to the teeth.

3. The apparatus of claim 2 wherein the baseplate further comprises at least one connection point.

4. The apparatus of claim 2 wherein the baseplate further comprises at least one cut-out portion.

5. The apparatus of claim 2 wherein the baseplate and the teeth are of a unitary construction.

6. The apparatus of claim 2, wherein the baseplate further comprises at least one flange.

7. The apparatus of claim 1 further comprising sharp edges within at least one of the restricted openings.

8. The apparatus of claim 1 wherein a top portion of at least one of the teeth is smooth to promote unimpeded travel of a bill.

9. The apparatus of claim 1 wherein an inner surface of at least one of the teeth is abrasive to promote obstruction of travel of a bill out of a cash box.

10. A bill acceptor comprising:

a bill validator including a bill entryway that leads to a first portion of a currency passageway;

a currency stacker and cash box assembly connected to the bill validator, the stacker and cash box assembly forming a second portion of a currency passageway therebetween; and a hook array positioned between the cash box and the bill validator, the hook array including a plurality of tree-shaped teeth that include restricted openings therebetween for capturing any string-like member attached to a bill, wherein at least some of the teeth that are adjacent one another in a direction across a width of the passageway partially overlap one another without contacting one another, and wherein the hook array is operative to inhibit retrieval of the bill from the cash box.

11. The bill acceptor of claim 10 wherein the hook array includes a baseplate having at least one connection point.

12. The bill accepter of claim 11 wherein the baseplate further comprises at least one cut-out portion.

13. The bill acceptor of claim 11 wherein the baseplate and the teeth are of a unitary construction.

14. The bill acceptor of claim 11, wherein the baseplate includes at least one flange.

15. The bill acceptor of claim 10 further comprising sharp edges within at least one of the restricted openings.

16. The bill acceptor of claim 10 wherein a top portion of at least one of the teeth is smooth to promote unimpeded travel of a bill into the cash box.

17. The bill acceptor of claim 10 wherein an inner surface of at least one of the teeth is abrasive to promote obstruction of travel of a bill out of a cash box.

18. A hook array for connection to a pusher plate of a bill stacker comprising a plurality of tree-shaped teeth that form restricted openings therebetween, wherein at least some of the teeth that are adjacent one another in a direction across a width of the passageway partially overlap one another without contacting one another, and wherein the teeth are angled to trap any a string-like member attached to a bill within a restricted opening to prevent extraction of a bill.

19. The apparatus of claim 18 wherein the hook array includes a baseplate having at least one connection point.

20. The apparatus of claim 19 wherein the baseplate further comprises at least one cut-out portion.

21. The apparatus of claim 19 wherein the baseplate and the teeth are of a unitary construction.

22. The apparatus of claim 19 wherein the baseplate further comprises at least one flange.

23. The apparatus of claim 18 further comprising sharp edges within at least one of the restricted openings.

24. The apparatus of claim 18 wherein a top portion of at least one of the teeth is smooth to promote unimpeded travel of a bill into the cash box.

25. The apparatus of claim 18 wherein an inner surface of at least one of the teeth is abrasive to promote obstruction of travel of a bill out of a cash box.

26. A method for preventing string-fraud comprising:

fabricating a hook array to have a plurality of tree-shaped teeth that form restricted openings therebetween;

attaching the hook array within a bill passageway between a bill validator and a cash box wherein at least some of the teeth that are adjacent one another in a direction across a width of the passageway partially overlap one another without contacting one another; and trapping any string-like member connected to a bill in the restricted openings.

27. The method of claim 26 wherein the hook array is connected to the cash box.

* * * * *

UNITED STATES PATENT AND TRADEMARK OFFICE

CERTIFICATE OF CORRECTION

PATENT NO. : 6,668,998 B1
DATED : December 30, 2003
INVENTOR(S) : Herb Mosteller and Robert Daniels It is certified that error appears in the above-identified patent and that said Letters Patent is hereby corrected as shown below:

Column 6,
Line 38, after "that" delete "my"

Column 7,
Line 31, after "trap" delete "any"

Signed and Sealed this

Fourth Day of May, 2004

JON W. DUDAS
*Acting Director of the United States Patent and Trademark Office*